United States Patent [19]

Farrier

[11] Patent Number: 5,038,697

[45] Date of Patent: Aug. 13, 1991

[54] VARIABLE BEAM FLOAT CONNECTION ASSEMBLIES FOR TRIMARANS

[76] Inventor: Ian L. Farrier, 320 Pearlwood St., Chula Vista, Calif. 92011

[21] Appl. No.: 402,677

[22] Filed: Sep. 5, 1989

[51] Int. Cl.[5] ..... B63B 1/14

[52] U.S. Cl. ..... 114/61; 114/123; 114/283

[58] Field of Search ..... 114/61, 123, 283

[56] References Cited

U.S. PATENT DOCUMENTS

| | | | |
|---|---|---|---|
| 4,392,444 | 7/1983 | Andersson | 114/126 |
| 4,457,248 | 7/1984 | Thurston | 114/123 |
| 4,878,447 | 11/1989 | Thurston | 114/61 |

*Primary Examiner*—Sherman D. Basinger
*Assistant Examiner*—Thomas J. Biahan
*Attorney, Agent, or Firm*—Charles C. Logan, II

[57] ABSTRACT

An improved version of the Float Connection Assemblies as described in U.S. Pat. No. 3,937,166, for the retraction of a trimaran's stabilizing floats to be alongside the trimaran center hull for trailering or Marina docking. The improvement consists of a variable length Upper Pivoting Guide Frame, that when varied in length will allow a trimaran float being retracted by the Float Connection Assemblies to assume a different, higher and more favorable position, to prevent marine growth on the floats' sides, particularly the topsides above the normal waterline when retracted.

This allows a trimaran incorporating this improved Float Connection Assembly to be easily converted from a trailerable configuration, to a more suitable Marina docking configuration, without the problem of underwater growth on the retracted float's side.

4 Claims, 2 Drawing Sheets

VARIABLE BEAM FLOAT CONNECTION ASSEMBLIES FOR TRIMARANS

This invention relates to an improved, variable beam, version of the Float Connection Assemblies as described in U.S. Pat. No. 3,937,166, that enable trimaran stabilizing floats to be retracted in against the center hull for trailering or Marina docking. The improvement herein described enables the folded beam to be varied in order to allow marina docking without the problem of marine growth on the retracted floats sides.

BACKGROUND OF THE INVENTION

Wide beam has always been a problem with trimarans, and the Float Connection Assemblies as described in U.S. Pat. No. 3,937,166 have solved this with a simple and effective method of retracting the stabilizing floats of trimaran to be alongside the center hull for trailering, or for docking in a standard marina slip. This system is now widely used.

However, a problem with marina docking has been underwater marine growth on the retracted float's sides. This can be overcome by varying the folded geometry of the Float Connection Assemblies as in U.S. Pat. No. 3,937,166, but the folded geometry required for lifting the float highher or positioning it at a better angle to avoid marine growth will then make the folded beam too large for legal trailering.

The float can be raised higher in the water by merely partially extending the floats of a trailerable trimaran with the described normal Float Connection Assemblies, but to lift or change the angle of the float sufficiently enough to avoid marine growth requires more beam than is usually allowable in a standard size slip.

It is, therefore, an object of this invention to provide an improved Float Connection Assembly that will overcome the above and other disadvantages. In particular, it is an object of this invention to provide a Float Connection Assembly that will allow retraction of the floats to a trailering width, yet offer a simple conversion procedure that will allow movement of the floats to a more suitable position for marina docking, the float being higher, or angled more favorably, to prevent marine growth on the float sides, but without creating an excessive overall beam.

SUMMARY OF THE INVENTION

With the foregoing and other objects in view, this invention resides broadly in a variable length Upper Pivoting Guide Frame that when varied in length will allow the retracted float and beam assembly to assume a higher or more favorably angled position, to prevent marine growth on the floats' sides, particularly the topsides above the normal waterline when retracted.

In order that the invention may be more readily understood and put into practical effect, reference will now be made to the accompanying drawings, which illustrate a preferred embodiment of the invention and wherein:

FIG. 1 is a front view of a Trimaran with the Float Connection Assembly as described in U.S. Pat. No. 3,937,166, with the floats in the extended position.

Figure 1:
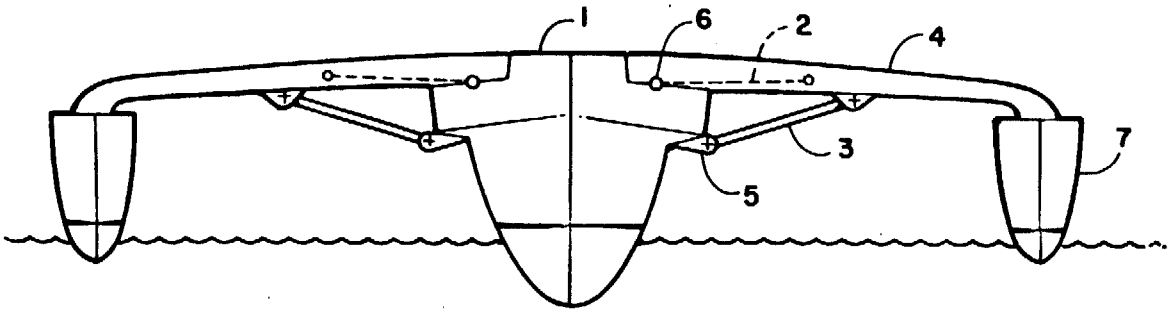
PRIOR ART FIGURE 1

Referring now to the drawings, in FIG. 1 there is shown a Float Connection Assembly, consisting of the Upper Pivoting Guide Frame 2, the Lower Pivoting Guide Frame 3 and the Connecting Beam 4, which attach to the Center Hull 1. This Float Connection Assembly as drawn, will allow the Float 7 to be retracted inwards to lie alongside the trimaran's center hull as shown by FIG. 2.

In the improved version, the Upper Pivoting Guide Frame 2 is designed in such a way as to be variable in length or action, either by telescopic means, a simple pivoting hinge, sliding hinge points, or by any other suitable means, in order to achieve a variable folded beam, more suitable for Marina docking.

Figure 2:
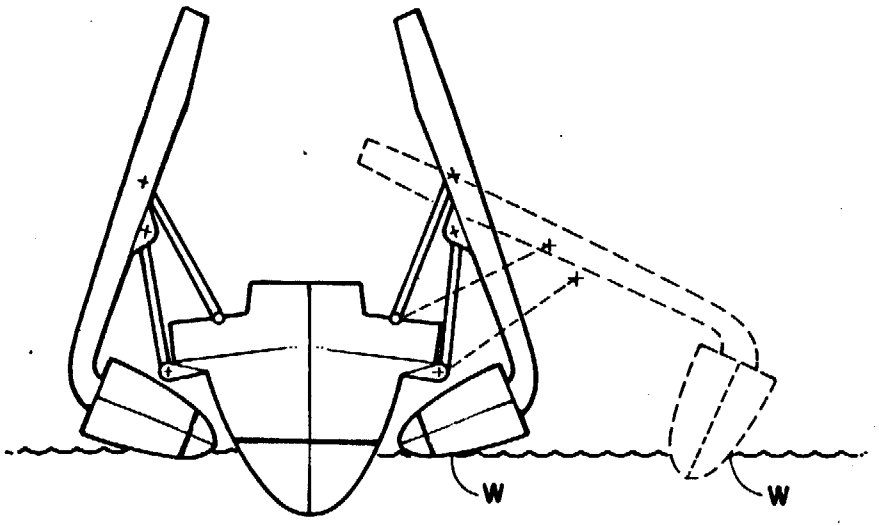
PRIOR ART FIGURE 2
FIG. 2 is a view of the Trimaran with the floats retracted to be in the usual trailering position.

FIG. 2 show the floats retracted normally for trailering, and it can be seen that the waterline W is over halfway up the retracted floats' sides, well above the design or normal waterline when fully extended, marine growth will be able to take hold in this area. The dotted lines show one float extended in the usual manner until the design waterline is near the actual water level W. In this case the beam is obviously too excessive to fit in a standard slip, and this method has not proved of any use in solving the problem of growth on the float sides.

Figure 3:
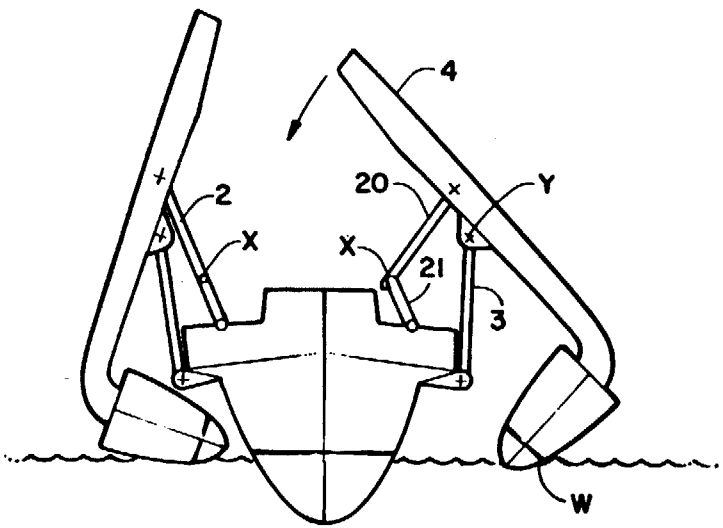
FIG. 3 is a view of the Trimaran with a variable length Upper Pivoting Frame being utilized to position the float higher in the water for a better marina docking position.

In the embodiment shown by FIG. 3, conversion to the Marina docking position is achieved by first retracting the floats into the normal trailering position. The lower Pivoting Guide Frames 3 are now locked in position shown by some means such as a locking pin, or restraining cable to the center hull. Once this is done the locking pin or other means of holding the Upper Pivoting Guide Frame 2 in the usual fixed length is released, allowing the Upper Guide Frame to vary its length, by pivoting about point X.

The float is then moved outwards in a 'secondary folding motion' pivoting about the now fixed pivot point Y, to the Marina docking position, by pulling in and down on the top part of the Connecting Beam 4. Once the float has reached the correct position, the Float Connection Assembly is locked in this position by a locking pin, or other means such as a restraining cable, locking bar between the beams, or a locking device that fixes the Upper Guide Frame at a shortened length. As can be seen, the water level W has been moved to below the design waterline without the folded beam becoming excessive for a standard slip. In this particular case the 'secondary folding motion' is performed every time the boat is fully folded for docking in a Marina Slip. The float is not folded directly into the Marina docking position.

Figure 4A:
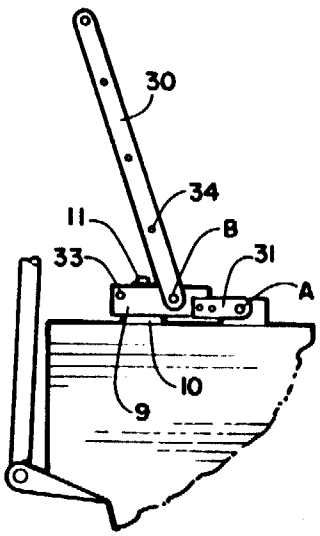
FIGS. 4A and 4B is a view of another type of variable length Upper Pivoting Frame that allows a more permanent conversion from a trailerable beam to a marina docking beam.
Figure 4B:
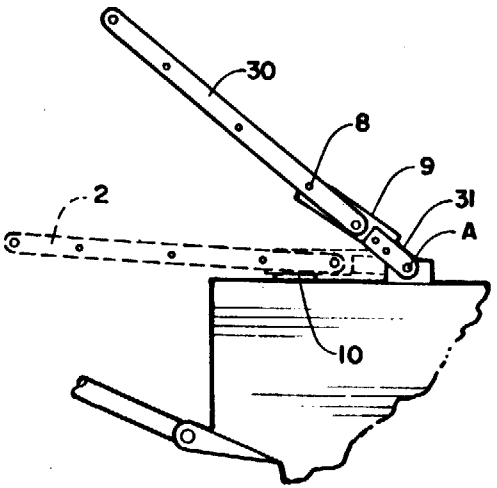
Figure 5A:
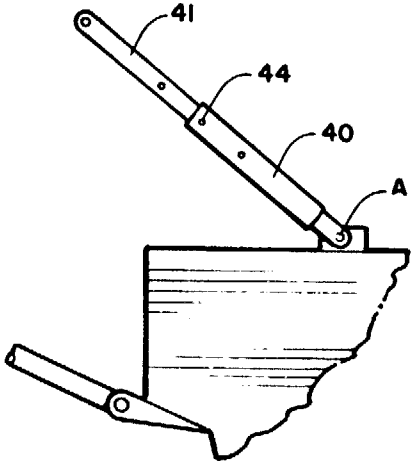
Figure 5B:
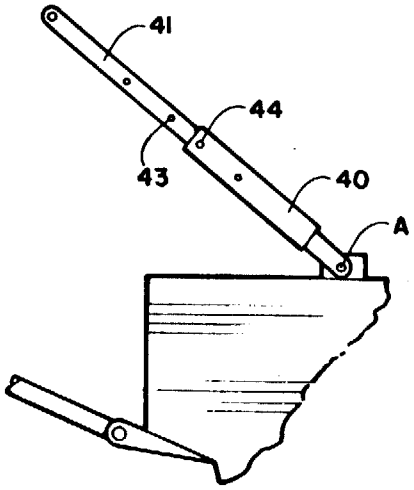
Figure 6A:
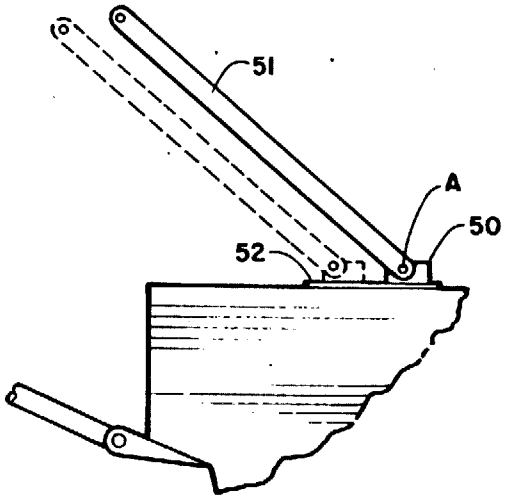
Figure 6B:
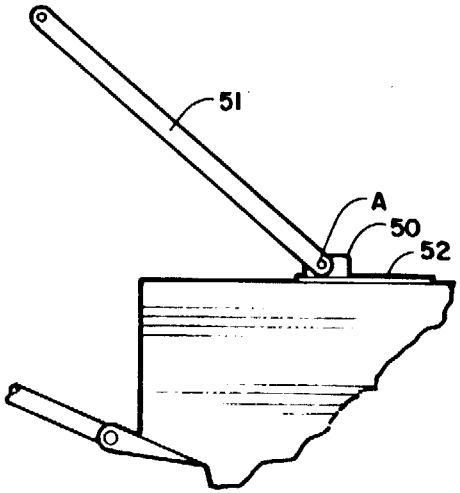

FIGS. 4A and 4B shows another embodiment of this Variable Beam Float Connection Assembly, wherein the top drawing shows the Upper Guide Frame 2 in its normal operation range for maximum retraction of the floats to an acceptable trailerable beam, while the lower drawing shows the Upper Guide Frame reconfigured for Marina docking. This embodiment uses a variable length pivoting Upper Guide Frame 2 having a second link arm 30 and a first link arm 31. Second link arm 30 has a bore hole 34 which is normally aligned with a bore hole 3 in inner block portion 9. In FIG. 4B, bolt 8 is inserted into the aligned bore holes 33 and 34. By releasing the lock pin or bolt 8, the inner block portion 9 of the Upper Guide Frame 2 can be bolted down onto bolt pad 10 by bolt 11 so as to move the effective pivot point from its normal position A to point B, effectively shortening the Upper Guide Frame.

This now allows the float to be retracted each time directly into the Marina Docking Position, without a 'secondary folding motion'. There is no need to shorten or alter the Upper Guide frame every time the trimaran is folded for docking in a slip. To restore full retraction to trailerable beam, the bolt 11 is removed, and the Upper Guide Frame 2 is straightened and locked into its full length position by the bolt or pin 8, restoring the original full length Upper Guide Frame, and moving the effective pivot point back to A. The trimaran can now be folded to a smaller beam, acceptable for trailering.

The advantages of these improvements are a quick and simple way of altering the position of the retracted floats so as to avoid underwater marine growth on the Float sides, without the folded beam becoming too great for a standard Marina Slip. It is then still a relatively easy procedure to restore the trimaran back to trailerable beam.

While the above has been given by way of illustrative example, it will, of course, be realized that many modifications of constructional detail and design may be made to the described embodiment and that the features of the invention may be utilized on other multi-hulled boats by persons skilled in the art without departing from the broad scope and ambit of the invention as is defined in the appended claims.

What I claim is:

1. A multi-hull boat comprising:

an elongated main hull having lateral sides and a longitudinally extending axis;

an elongated first stabilizing float having a longitudinally extending axis;

the longitudinal axis of said first float is laterally spaced from the longitudinal axis of said main hull and they are oriented substantially parallel to each other;

a first elongated connecting beam having an inner end and an outer end, said first connecting beam being a substantially rigid nonbendable structure;

the outer end of said first connecting beam being rigidly connected to said first stabilizing float;

a first elongated upper pivoting guide frame assembly having an inner end and an outer end;

a first elongated lower pivoting guide frame having an inner end and an outer end, said lower pivoting guide frame being a substantially rigid nonbendable structure, the inner end of said lower pivoting guide frame being pivotally connected to one of the lateral sides of said main hull, the outer end of said lower pivoting guide frame being pivotally connected to said connecting beam at a predetermined point intermediate its opposite ends;

said upper and lower pivoting guide frames functioning to allow said first stabilizing float to be positioned on the water with said first connecting beam in a substantially horizontal orientation and also allow said first connecting beam to be retracted to a first upright position that would be used when trailering said multi-hull boat; and means for varying the length of one of said pivoting guide frames to provide a second upright position for said first connecting beam which would be used when mooring the boat in a marina docking slip, this second upright position prevents said first float from having its area above its normal water line from resting in the water where it would experience marine growth thereon, said means for varying the length of one of said pivoting guide frames comprises said upper pivoting guide frame assembly being formed from a first link arm and a second link arm, one end of said first link arm is pivotally connected to said main hull and its other end is pivotally connected to said second link arm whose one end is pivotally connected to said connecting beam at a point intermediate its inner end and the point where said lower pivoting guide frame is connected thereto, and means for locking said first and second link arms with their longitudinal axes longitudinally aligned.

2. A multi-hull boat as recited in claim 1 wherein said upper pivoting guide frame assembly further comprises an elongated inner block portion having an inner end and an outer end, said inner end is rigidly connected to one end of said first link arm, said second link arm having one of its ends pivotally connected to said elongated inner block portion intermediate its opposite ends at a predetermined point, and means for detachably securing the outer end of said elongated inner block portion to said second link arm so that they are longitudinally aligned.

3. A multi-hull boat as recited in claim 2 wherein said means for detachably securing the outer end of said elongated inner block portion to said second link arm comprises a laterally oriented bore hole in said elongated inner block portion that aligns with a laterally oriented bore hole in said second link arm and a bolt that is removably received in said aligned bore holes.

4. A multi-hull boat as recited in claim 2 further comprising means for detachably securing said bolt pad to said main hull when said first stabilizing float has been folded to its marina mooring position.

* * * * *